US005358027A

United States Patent [19]

Callihan et al.

[11] Patent Number: 5,358,027

[45] Date of Patent: Oct. 25, 1994

[54] VACUUM-ASSISTED GRAVITY POUR CASTING APPARATUS

[75] Inventors: Douglas R. Callihan, Lebanon; Mark A. Cassel, Hummelstown; Charles H. Kinloch, Cornwall, all of Pa.; Jesse M. Raver, Trenton, Mich.

[73] Assignee: CMI International, Southfield, Mich.

[21] Appl. No.: 26,699

[22] Filed: Mar. 5, 1993

[51] Int. Cl.[5] ..... B22D 18/00

[52] U.S. Cl. ..... 164/256; 164/254; 164/258

[58] Field of Search ..... 164/61, 63, 65, 254, 164/255, 256, 258, 335, 337

[56] References Cited

U.S. PATENT DOCUMENTS

| | | | |
|---|---|---|---|
| 2,140,607 | 12/1938 | Thompson . | |
| 2,871,533 | 2/1959 | Swainson | 164/337 |
| 2,976,587 | 3/1961 | Daussan . | |
| 3,013,316 | 12/1961 | Hornak et al. . | |
| 3,517,728 | 6/1970 | Taccone . | |
| 3,536,125 | 10/1970 | Blasko et al. . | |
| 3,554,268 | 1/1971 | Taylor et al. . | |
| 3,677,332 | 7/1972 | Smiernow . | |
| 3,863,706 | 2/1975 | Chandley et al. . | |
| 4,055,216 | 10/1977 | Ulyanov et al. . | |
| 4,541,475 | 9/1985 | Goddard et al. . | |
| 5,230,379 | 7/1993 | Voss | 164/255 |

FOREIGN PATENT DOCUMENTS

| | | | |
|---|---|---|---|
| 61-27163 | 2/1986 | Japan | 164/61 |

*Primary Examiner*—Kuang Y. Lin

*Attorney, Agent, or Firm*—Reising, Ethington, Barnard, Perry & Milton

[57] ABSTRACT

A vacuum-assisted gravity pour casting apparatus (10) has a vacuum housing (12) with a fixed top portion (14) and a moveable bottom portion (16). A lower portion (80) of a filling vessel (62) extends through an opening (30) in the top portion (14) and seals the opening (30) against leakage. The bottom housing portion (16) is supported on a scissors-lift mechanism (48) which lowers and raises the bottom portion (16) to open and close the chamber (20) for cycling molds into and out of the chamber (20). A stopper rod (86) controls the flow of molten metal (M) through a bottom nozzle (70) and into the mold.

20 Claims, 1 Drawing Sheet

VACUUM-ASSISTED GRAVITY POUR CASTING APPARATUS

BACKGROUND OF THE INVENTION

1. Technical Field

This invention relates generally to metal casting and more particularly to vacuum-assisted gravity pour casting apparatus.

2. Related Prior Art

Gravity casting is conventionally used to manufacture metal cast articles having a variety of geometrical configurations. Difficulties have been encountered, however, when casting articles of intricate shape and/or thin section using conventional gravity pour casting, as such articles have a tendency to not fully develop during casting.

Before this invention, various vacuum-assisted gravity pour casting apparatus have been proposed which could be utilized for producing articles of intricate shape and/or thin section. Exemplary of such apparatus are those disclosed in U.S. Pat. No. 4,055,216, granted Oct. 25, 1977, in the name of Ulyanov et al.; and U.S. Pat. No. 4,541,475, granted Sep. 17, 1985, in the name of Goddard et al. Each discloses a vacuum chamber enclosing both a melting vessel and a casting mold. A vacuum chamber of such size, however, is expensive to manufacture and operate and hence limited in application. Equipment is further required for cycling the pouring vessel into and out of the chamber and melting metal within the vessel before pouring.

SUMMARY OF INVENTION AND ADVANTAGES

An apparatus for casting molten metal comprises vacuum enclosure means having separable top and bottom enclosure portions defining a chamber therebetween for enclosing a casting mold. Vacuum means communicate with the enclosure means for creating a vacuum pressure within the chamber. Support means are provided for supporting the top enclosure portion in fixed position above the bottom enclosure portion. Means are provided for moving the bottom enclosure portion in relation to the top enclosure portion for selectively opening and closing the enclosure means to enable casting molds to be cycled into and out of the chamber. A filling vessel is mounted on the top enclosure portion having an upper portion thereof supported outside of the chamber and exposed to the atmosphere and a nozzle communicating with an opening in the top enclosure portion for delivering molten metal into the chamber for casting within the mold. The vessel seals the opening in the top enclosure portion against leakage for maintaining a vacuum pressure within the chamber during casting.

An advantage of this invention is the use of a smaller vacuum enclosure for housing the mold within the chamber while supporting at least a portion of the filing vessel outside of the chamber. The smaller enclosure is less costly to manufacture and operate, takes up less floor space, uses less costly evacuation equipment, and hence is more suitable for use by smaller casting facilities.

Another advantage is that locating the pouring vessel outside of the vacuum chamber provides easier access to the vessel thereby simplifying the construction of the apparatus and decreasing potential operation cycle time.

BRIEF DESCRIPTION OF THE DRAWINGS

Other advantages of the present invention will be readily appreciated as the same becomes better understood by reference to the following detailed description when considered in connection with the accompanying drawing wherein.

DETAILED DESCRIPTION OF THE PREFERRED EMBODIMENT

Figure 1:
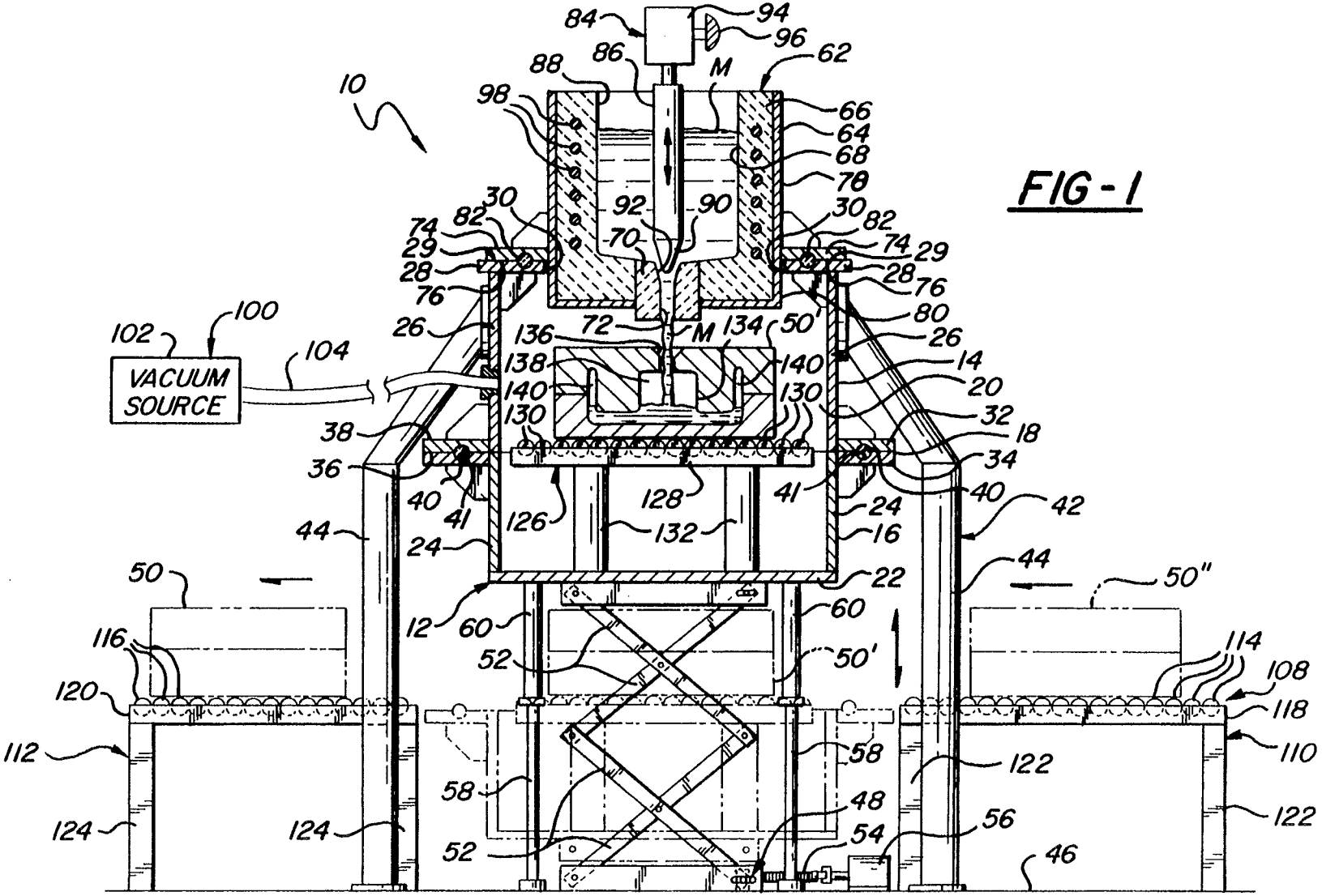
FIG. 1 is a schematic elevation view shown partially in section of a casting apparatus constructed in accordance with the present invention.

Turning now in more detail to the drawing, a vacuum-assisted gravity pour casting apparatus constructed in accordance to a presently preferred embodiment of the invention is indicated generally at 10 and includes vacuum enclosure means or a vacuum enclosure 12 having separable top 14 and bottom 16 enclosure portions engageable along a parting line 18 defining a vacuum chamber 20 therebetween.

The bottom enclosure portion 16 has a horizontally disposed plate-like bottom wall 22 and four vertically disposed continuous plate-like side walls 24 joined in sealing engagement with the bottom wall 22, such as by welding, and extending upwardly therefrom such that together, the bottom wall 22 and side walls 24 define an open top box-like structure. The top enclosure portion 14, likewise includes four vertically disposed continuous side walls 26 aligned vertically with the bottom side walls 24 and separable therefrom along the parting line 18. The upper side walls 26 are fixedly connected at an uppermost end thereof to a horizontally disposed annular ring-like top wall or flange 28 extending inwardly of the side walls 26 defining a horizontal upper support surface 29. A large annular opening 30 is formed in the top wall 28 and is surrounded peripherally by the top wall support surface 29. As will be explained in greater detail below, the opening 30 serves as an access for admitting molten metal M into the chamber 20.

The top 24 and bottom 26 side walls include respective outer sealing flanges 32 and 34 that extend perpendicularly outwardly of the side walls 24, 26 and continuously around an outer perimeter of each of the side walls 24, 26 presenting generally planar horizontally disposed sealing surfaces 36, 38 engageable along parting line 18. A continuous ring-like sealing gasket 40 is disposed between the sealing surfaces 36, 38 for intimately contacting the sealing surfaces 36, 38 when the surfaces 36, 38 are brought into engagement so as to perfect a vacuum-tight seal between the top and bottom enclosure portions 14, 16. The sealing gasket 40 may comprise a crush bead refractory gasket or other suitable heat resistant gasket types known to the art. One or both of the sealing surfaces 36, 38 may be formed with a recessed channel or seat 41 for receiving and supporting the gasket 40.

The top enclosure portion 14 is supported in fixed, stationary position above the bottom enclosure portion 16 by support means 42, comprising rigid support legs 44 extending upwardly from a support surface 46 such as a floor, and securely attached to the side walls 26 of the top enclosure portion 14.

The bottom enclosure portion 16 is supported for movement with respect to the top enclosure portion 14 for selectively opening and closing the chamber 20 for cycling casting molds into and out of the chamber 20. More specifically, a lifting means or mechanism 48 is provided for supporting the bottom enclosure portion 16 independently of the top enclosure portion 14 and selectively moving the bottom enclosure portion 16 vertically with respect to the top enclosure portion 14 between an open chamber position (shown in phantom) in which the bottom enclosure portion 16 is spaced below the top enclosure portion 14 to open the chamber 20 for cycling casting molds 50, 50', 50" successively into and out of the chamber 20, and a closed chamber position (shown in solid lines) in which the bottom enclosure portion 16 is raised into sealing engagement with the top enclosure portion 14 for enclosing at least one of the molds within the chamber 20.

The lifting mechanism 48 may comprise any of a number of different mechanisms suitable for raising and lowering the bottom enclosure portion 16 and mold, but preferably comprises a mechanical or electromechanical scissors-type lifting mechanism 48 which is shown schematically in the drawing as including a lattice work of criss-crossing lifting arms 52 connected at one end to the bottom enclosure portion 16 and operatively connected at an opposite end to the support surface 46. The lifting arms 52 are coupled to an actuating mechanism, such as a ball screw 54 and reversible electric motor 56, for moving the arms 52 to selectively raise or lower the bottom enclosure portion 16 in relation to the top portion 14. Vertical guide posts 58 extend up from the support surface 46 and are slidably received within associated guide sleeves 60 depending from the bottom enclosure portion 16 for guiding the bottom enclosure portion 16 vertically between the open and closed-chamber positions.

The apparatus 10 further includes a filling vessel 62 mounted on the top enclosure portion 14 and supported above the lower enclosure portion 16 by the support means 42. More specifically, the support legs 44 of the support means 42 are spaced outwardly from the sides 24 of the lower enclosure portion 16 so as to not interfere with the movement of the lower enclosure portion 16.

The filling vessel 62 comprises an outer metal shell 64 lined with a refractory material 66 and defining a reservoir 68 therein for containing a supply of the molten metal M to be cast into the molds. The vessel 62 includes a pouring nozzle 70 disposed in a bottom wall of the vessel 62 and having an aperture 72 serving as a bottom outlet for the molten metal M with the vessel 62. When the vessel 62 is mounted on the enclosure 12, the nozzle 70 is supported in communication with the opening 30 for directing the molten metal M of the vessel 62 into the chamber 20.

The vessel 62 further includes a flange or skirt 74 extending about an outer periphery of the shell 64 and presenting a generally horizontally disposed shoulder or sealing surface 76 which engages the upper support surface 29 of the top wall 28 when the vessel 62 is mounted on the top enclosure portion 14. Another crush bead refractory sealing gasket 82, or other suitable temperature resistant gasket, is provided between the sealing surface 76 of the skirt 74 and the support surface 29 of the top wall 28 for perfecting a gas-tight vacuum seal between the vessel 62 and top enclosure portion 14 to seal the opening 30 against leakage when the vessel 62 is mounted to the top enclosure portion 14. In this manner, the vessel 62 acts as a lid or cover for the vacuum enclosure means 12 rendering the chamber 20 air-tight when the vessel 62 is mounted on the top enclosure portion 14 and the chamber 20 is closed. The weight of the vessel 62 itself may be sufficient to press the gasket 82 between the vessel 62 and top enclosure portion 14 and perfect the seal, although clamps or fasteners (not shown) may be utilized to provide additional clamping force.

As shown in the drawing, an upper portion 78 of the vessel 62 lies above the skirt 74 and a lower portion 80 lies below the skirt 74. The lower portion 80 of the vessel 62 may extend a short distance (approximately four inches) into the chamber 20 through the opening 30, as illustrated in the drawing. The lower portion 80 has an outer shape and dimension which is approximately equal to or smaller than that of the opening 30 and as such serves to properly align the vessel 62 on the top enclosure portion 14. The substantial remaining upper portion 78 of the vessel 62 is supported outside of the chamber 20 above the vacuum enclosure means 12 and exposed to the external atmosphere. In this way, the vacuum chamber 20 does not have to be so large as to house both the mold 50 and entire filling vessel 62, but rather only large enough to accommodate the mold and preferably only a small portion of the vessel 62.

Stopper rod control means 84 are provided for regulating the flow of the molten metal M through the nozzle 70. The control means 84 includes a stopper rod 86 extending through an open top 88 of the vessel 62 into the reservoir 68 and the rod 86 includes a male conical-shaped nose 90 at a lower end thereof for communicating with a corresponding female conical seating surface 92 of the nozzle 70. When nose 90 and seating surface 92 are engaged, the metal M is prevented from flowing out of the vessel 62 through the nozzle 70. The open top 88 may be left open during casting or may be closed by a refractory blanket or other suitable insulating cover (not shown). An upper end of the stopper rod 86 is coupled to a control mechanism 94 mounted to a support structure 96 for selectively raising and lowering the stopper rod 86 in relation to the nozzle 70 to either increase or decrease the spacing between the nose 90 and seating surface 92 to thereby regulate the flow of metal through the aperture 72 of the nozzle 70. The control mechanism 94 may be any type known the art conventionally used for controlling the movement of stopper rods.

The vessel 62 may further be provided with heating means in the preferred form of induction heating coils 98 embedded in the lining 66 surrounding the reservoir 68 and suitably controlled for regulating the temperature of the metal M within the reservoir 68.

Vacuum means 100 communicates with the vacuum enclosure 12 for creating a vacuum pressure environment within the chamber 20 during pouring. The vacuum means 100 comprises a vacuum source 102 (i.e. a pump) coupled preferably to one of the side walls 26 of the top enclosure portion 14 through line 104 for selectively evacuating the chamber 20 when the chamber 20 is closed and the vessel 62 is mounted on the top enclosure portion 14.

Conveyor means 108, in the preferred form of a roller conveyor, is provided for conveying the successive casting molds (e.g., 50, 50', 50") into and out of the chamber 20. As shown in the drawing, the conveyor 108 comprises a loading platform 110 and an unloading platform 112 disposed on opposing sides of the vacuum enclosure 12 and each including a plurality of horizontally disposed roller elements 114, 116 mounted on respective conveyor tables 118, 120 supported off the support surface 46 by legs 122, 124.

A filled mold 50 is shown supported on the unloading platform 112, and a mold in waiting 50'' is shown supported on the loading platform 114. The bottom enclosure portion 16 is further provided with a central platform 126 for supporting each of the casting molds within the chamber 20 during casting. The mold 50' is shown supported on the platform 126 in the drawing. The platform 126 likewise includes a horizontally disposed conveyor table 128 mounting a plurality of roller elements 130 and supported off the bottom wall 22 of the bottom enclosure portion 16 by stationary legs 132 such that the platform 126 moves together with the bottom enclosure portion 16 between the open and closed chamber positions. As shown in the drawing, the tables 118, 120 are spaced sufficiently from one another to enable the bottom enclosure portion 16 and flange 34 to pass between the tables 118, 120 when moved to the open chamber position. Further, the table 128 is supported so that when the bottom enclosure portion 16 is in the open chamber position, the table 128 is aligned with (i.e., at the same level as) the tables 118, 120 of the loading and unloading platforms 110, 112 to enable empty casting molds to be cycled into the chamber 20 and molds that have been filled with the molten metal M to be cycled out of the chamber 20.

In operation, the filling vessel 62 is supplied with a quantity of the molten metal M and is lowered into engagement with top enclosure portion 14 so that the lower portion 80 of the vessel 62 projects into the chamber 20 through the opening 30 and the peripheral skirt 74 of the vessel 62 engages the support surface 29 of the top wall 28 and compresses the sealing gasket 82 therebetween establishing a gas-tight seal between the vessel 62 and top enclosure portion 14 thereby sealing off the opening 30. The top portion 16 of the vessel 62 is, however, supported outside of the chamber 20 above the vacuum enclosure 12 and exposed to the atmosphere.

The plurality of casting molds (e.g., 50, 50', 50'') are prepared and transported sequentially toward the enclosure 12 by the conveyor 108. The molds may be conventional sand foundry molds each formed with a cavity 134 therein and a sprue 136 serving as a molten metal inlet into the cavity 134. As shown in the drawings, the cavity 134 may have some sections 138 that are relatively thick in cross section, whereas other sections 140 of the cavity 134 may be relatively thinner.

To cast molten metal within a mold, the lifting mechanism 48 is actuated lowering the bottom enclosure portion 16 to the open chamber position wherein the central platform 126 is aligned with the loading and unloading platforms 110, 112. An empty mold (e.g., 50' in the drawing) is conveyed onto the central platform 126 and the lifting mechanism 48 again actuated raising the bottom enclosure portion 16 and mold 50' upwardly until the sealing flange 34 of the bottom enclosure portion 16 engages the corresponding sealing flange 32 of the upper enclosure portion 14 capturing the gasket 40 therebetween and perfecting a gas-tight seal between the top and bottom enclosure portions 14, 16 and enclosing the mold 50' within the chamber 20.

The chamber 20 and mold cavity 134 are then evacuated through operation of the vacuum source 102. Once the chamber 20 and cavity 126 are evacuated, the stopper rod control mechanism 84 is actuated raising the stopper rod 86 out of engagement with the nozzle 70 permitting the molten metal M to be discharged from the vessel 62 through the nozzle 70 and opening 30 and into the cavity 134 of the mold 50', as shown in the drawing. The vacuum pressure within the cavity 134 assists in completely filling the thin sections 140 of the cavity 134 with the molten metal M.

After the cavity 134 has been completely filled with molten metal M, the stopper rod 86 is moved into seating engagement with the nozzle 70 stopping the flow of molten metal M from the vessel 62. The enclosure 12 is then opened and the filled mold conveyed off the central platform 126 onto the unloading platform 112. The metal M in the cavity 134 may be allowed to solidify while the mold 50' is still in the chamber 20 or, alternatively, after the chamber 20 has been opened. As the filled mold 50' is conveyed off the central platform 126 and onto the unloading platform 112, the next-in-line empty mold (e.g., 50'') may be simultaneously conveyed onto the central platform 126 and the casting cycle repeated.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims wherein reference numerals are merely for convenience and are not to be in any way limiting, the invention may be practiced otherwise than as specifically described.

What is claimed is:

1. An apparatus for casting molten metal into molds, said apparatus comprising:

vacuum enclosure means (12) having separable top (14) and bottom (16) enclosure portions defining a chamber (20) therebetween for enclosing a casting mold, said top enclosure portion (14) having an inlet opening (30) therein;

support means (42) for supporting said top enclosure portion (14) in fixed position above said bottom enclosure portion (16);

means (48) for moving said bottom enclosure portion (16) in relation to said top enclosure portion (14) for selectively opening and closing said enclosure means (12) for enabling casting molds to be cycled into add out of said chamber (20);

vacuum means (100) communicating with said enclosure means (12) for creating a vacuum pressure within said chamber (20); and a filling vessel (62) mounted on said top enclosure portion (14) and having an upper portion (78) thereof supported outside of said chamber (20) and exposed to atmosphere and a lower portion (80) extending through said opening (30) into said chamber (20) and having a nozzle (70) for delivering molten metal (M) into said chamber (20) from said vessel (62) for casting within a cavity of the mold, said vessel (62) sealingly engaging said top enclosure portion (14) closing off said opening (30) and perfecting a gas-tight seal between said vessel (62) and said top enclosure portion (14).

2. An apparatus as set forth in claim 1 wherein said vessel (62) has a flange (74) extending about an outer periphery of said vessel (62) and defining a generally horizontally disposed sealing surface (76) of said vessel (62).

3. An apparatus as set forth in claim 2 wherein said top enclosure portion (14) defines an annular generally horizontal support surface (29) surrounding said opening (30).

4. An apparatus as set forth in claim 3 wherein said sealing surface (76) of said vessel (62) engages said support surface (29) of said top enclosure portion (14).

5. An apparatus as set forth in claim 4 including sealing means (82) disposed between said sealing surface (76) of said vessel (62) and said support surface (29) of said top enclosure portion (14) for perfecting a gas-tight seal between said vessel (62) and said top enclosure portion (14).

6. An apparatus as set forth in claim 5 wherein said flange (74) separates said upper portion (78) of said vessel (62) from said lower portion (80).

7. An apparatus as set forth in claim 1 including stopper rod control means (84) communicating with said nozzle (70) for regulating the flow of molten metal (M) through said nozzle (70).

8. An apparatus as set forth in claim 7 wherein said stopper rod control means (84) includes a stopper rod (86) extending into said vessel (62).

9. An apparatus as set forth in claim 8 wherein said vessel (62) includes heating means.

10. An apparatus as set forth in claim 10 wherein said heating means (98) comprises induction heating coils.

11. An apparatus as set forth in claim 1 wherein said means (48) for moving said bottom enclosure portion (16) comprises a lifting mechanism (48) supporting said bottom enclosure portion (16) independently of said top enclosure portion (14) for moving said bottom enclosure portion (16) vertically relative to said top enclosure portion (14) between an open-chamber position in which said bottom enclosure portion (16) is spaced below said top enclosure portion (14), and a closed-chamber position in which said bottom enclosure portion (16) is raised into sealing engagement with said top enclosure portion (14).

12. An apparatus as set forth in claim 11 wherein said lifting mechanism (48) comprises a scissors-type lifting mechanism.

13. An apparatus as set forth in claim 11 wherein said top enclosure portion (14) has a sealing flange (32) and said bottom enclosure portion (16) has a corresponding sealing flange (34), said flanges (32), (34) engaging one another when said bottom enclosure portion (16) is positioned in said closed-chamber position.

14. An apparatus as set forth in claim 13 including a sealing gasket (40) disposed between said top (32) and bottom (34) enclosure flanges for perfecting a gas-tight seal between said top (14) and bottom (16) enclosure portions when in said closed-chamber position.

15. An apparatus as set forth in claim 1 including conveyor means (108) for conveying casting molds into and out of said vacuum enclosure means (12).

16. An apparatus as set forth in claim 15 wherein said conveyor means (108) comprises a roller conveyor.

17. An apparatus as set forth in claim 16 wherein said roller conveyor (108) has a central platform (126) mounted to said bottom enclosure portion (16) for supporting a mold within said chamber (20).

18. An apparatus as set forth in claim 17 wherein said roller conveyor (108) includes a loading platform (110) and an unloading platform (112) disposed on opposite sides of said vacuum enclosure means (12).

19. An apparatus as set forth in claim 18 wherein said loading and unloading platforms (110), (112) are spaced from one another sufficiently to enable said bottom enclosure portion (16) to pass therebetween when moved to said open-chamber position.

20. An apparatus as set forth in claim 19 wherein said central platform (120) is aligned horizontally with said loading and unloading platforms (110), (112) when said bottom enclosure portion (16) is positioned in said open-chamber position.

* * * * *